US005260745A

United States Patent [19]

Takayanagi

[11] Patent Number: 5,260,745

[45] Date of Patent: Nov. 9, 1993

[54] IMAGE EXPOSING AND FORMING APPARATUS WITH ORIGINAL DENSITY DETECTION

[75] Inventor: Yoshiaki Takayanagi, Yokohama, Japan

[73] Assignee: Canon Kabushiki Kaisha, Tokyo, Japan

[21] Appl. No.: 998,764

[22] Filed: Dec. 30, 1992

Related U.S. Application Data

[63] Continuation of Ser. No. 707,956, May 22, 1991, abandoned, which is a continuation of Ser. No. 163,130, Feb. 19, 1988, abandoned, which is a continuation of Ser. No. 812,337, Dec. 23, 1985, abandoned.

[30] Foreign Application Priority Data

| | | | |
|---|---|---|---|
| Dec. 26, 1984 | [JP] | Japan | 59-276935 |
| Dec. 26, 1984 | [JP] | Japan | 59-276936 |
| Dec. 26, 1984 | [JP] | Japan | 59-276937 |
| Dec. 26, 1984 | [JP] | Japan | 59-276938 |
| Dec. 26, 1984 | [JP] | Japan | 59-276939 |

[51] Int. Cl.[5] ..... G03G 15/04; G03G 15/00

[52] U.S. Cl. ..... 355/208; 355/68; 355/69; 355/228

[58] Field of Search ..... 355/203, 208, 214, 228, 355/229, 246, 68, 69

[56] References Cited

U.S. PATENT DOCUMENTS

| | | | |
|---|---|---|---|
| 2,956,487 | 10/1960 | Giaimo, Jr. | 355/14 D |
| 3,877,413 | 4/1975 | Rowell et al. | 355/14 D X |
| 4,124,294 | 11/1978 | Nakamura | 355/68 |
| 4,390,266 | 6/1983 | Uchida | 355/14 E |
| 4,402,598 | 9/1983 | Tomosada et al. | 355/69 |
| 4,467,246 | 8/1984 | Tanaka et al. | 315/158 |
| 4,540,279 | 9/1985 | Irie et al. | 355/69 |
| 4,564,287 | 1/1986 | Suzuki et al. | 355/14 E X |
| 4,624,548 | 11/1986 | Takayanagi | 355/206 |
| 4,627,712 | 12/1986 | Usami | 355/206 |
| 4,640,603 | 2/1987 | Honma | 355/14 E |
| 4,660,961 | 4/1987 | Kuramoto | 355/3 R X |
| 4,677,287 | 6/1987 | Ejima | 250/205 |
| 4,702,590 | 10/1987 | Usami | 355/14 E X |

*Primary Examiner*—Joan H. Pendegrass

*Attorney, Agent, or Firm*—Fitzpatrick, Cella, Harper & Scinto

[57] ABSTRACT

An original image processing apparatus such as a copying machine has a fluorescent lamp for exposing an original image, a photodiode for detecting the quantity of light reflected from a standard white plate or the original, an optical system for forming an image on a transfer sheet, and a control circuit for controlling the DC vias of a developing unit in accordance with a detection result of the photodiode. The apparatus can form images at optimal densities.

20 Claims, 6 Drawing Sheets

IMAGE EXPOSING AND FORMING APPARATUS WITH ORIGINAL DENSITY DETECTION

This application is a continuation of application Ser. No. 07/070,956, filed May 22, 1991, which was a continuation of application Ser. No. 07/163,130, filed Feb. 19, 1988, which is a continuation of application Ser. No. 06/812,337, filed Dec. 23, 1985, all now abandoned.

BACKGROUND OF THE INVENTION

1. Field of the Invention

The present invention relates to an original image processing apparatus for processing original images of books or documents, such as copying machines or facsimile systems.

2. Description of the Prior Art

In conventional copying machines, originals to be copied are exposed to light from light sources such as halogen lamps or fluorescent lamps, and images are formed by light reflected from the originals. Therefore, the image density depends on the brightness of the light sources used for exposing the originals. In order to form images a predetermined density, the light sources must be turned to emit a predetermined quantity of light.

A means has been proposed for automatically controlling the operation of a processing section for forming images in accordance with original image density and for forming high-quality images.

However, since the density of the images depends on the brightness of the light source used, even if the processing section is properly operated, an image of good quality cannot be formed if the quantity of light is not suitable.

In view of the above problem, it has been proposed to detect the quantity of light emitted by a light source and to control the light source in accordance with the quantity of light detected.

It has also been proposed to measure the density of an original image and to control an image formation process in accordance with a measurement of the density of the original image.

However, the provision of sensors for controlling the quantity of light and image formation process are not preferable from the viewpoints of high cost and complexity of the structure.

SUMMARY OF THE INVENTION

The present invention has been made in view of the above and has as its object to provide an original image processing apparatus which can process original images in copying machines and facsimile systems.

It is another object of the present invention to expose originals with optimal quantities of light.

It is still another object of the present invention to correctly discriminate image states of originals.

It is still another object of the present invention to form images suitable to originals.

The invention which achieves these objectives relates to an original image processing apparatus. The invention comprises a light source of illuminating and exposing an original to a quantity of light corresponding to the amount of electric power supplied to the light source. Also provided is means for determining the amount of electric power to be supplied to the light source so as to illuminate the light source to emit a predetermined quantity of light. The quantity of light from the original exposed to light from the light source is detected, and a condition (such as the quantity of light reflected from the original) corresponding to a characteristic of said original (such as the image density of the original) is discriminated in accordance with the output of said detecting means. The discriminating means determines the condition corresponding to a characteristic of the original (i.e., the image density) after the amount of electric power to be supplied to the light source is determined. Also provided is a control means for controlling the formation of an image of the original by a developing unit in accordance with the light quantity detected means when the original is exposed to light from the light source.

Therefore, once the original is illuminated, the image density and the amount of light reflected from the original are determined, and this information can be used by the control means to adjust the bias on the developing unit to produce a copy of the original image which has an optimal density.

The above and other objects, features and advantages of the present invention will become apparent from the following description when taken in conjunction with the accompanying drawings.

DETAILED DESCRIPTION OF THE PREFERRED EMBODIMENTS

The preferred embodiments of the present invention will be described below with reference to the accompanying drawings.

Figure 1:
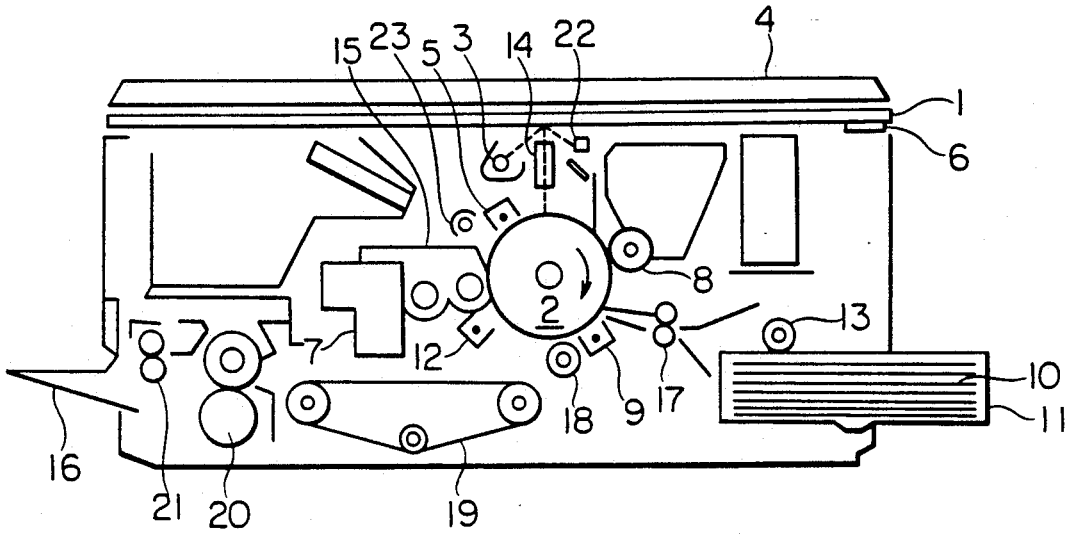
FIG. 1 is a sectional view showing the construction of a copying machine to which the present invention can be applied.

FIG. 1 is a sectional view showing the construction of a copying machine to which the present invention is applied. (The machine shown in FIG. 1 is an example of the class of devices termed "image processing" apparatus herein, that class including devices which perform any kind of processing on an image, such as copying of the image.) Referring to FIG. 1, a platen 1 is a transparent glass plate. A cover 4 fixes an original placed on the platen 1 and can be opened or closed. The platen 1 and the cover 4 are reciprocated together by a drive mechanism (not shown). A standard white plate 6 is arranged on the lower surface at the distal end of the platen 1. A drum 2 is rotatable and has a photosensitive layer comprising an organic semiconductor (OPC) without a boundary around a cylindrical conductor base. A fluorescent lamp 3 is provided for exposing an image of the original placed on the plate 1. A pre-exposure lamp 23 pre-exposes the drum 2 before exposure. A primary charges 5 charges the drum surface to a negative polarity before the exposure operation. A developing unit 8 forms an electrostatic latent image formed on the drum 2. A transfer charger 9 is provided for transferring the latent image on the drum 2 onto a transfer sheet 10. A cassette 11 stores a number of transfer sheets 10 and is detachable. A pickup roller 13 picks up the transfer sheets 10 one by one from the cassette 11. Register rollers 17 register the leading edge of the transfer sheet 10 with the leading edge of an image on the drum 2. A separation roller 18 separates the transfer sheet 10 from the drum 2. A belt 19 conveys the transfer sheet 10. Fixing rollers 20 fix the image on the transfer sheet 10. Exhaust rollers 21 exhaust the transfer sheet 10 onto a tray 16. A cleaner 15 cleans residual toner on the drum 2 after transfer operation. A cleaning predischarger 12 predischarges so as to allow easy removal of the residual toner by the cleaner 15. A container 7 contains toner recovered from the drum surface. A focusing rod lens array 14 focuses light reflected from the original onto the drum surface. A photodiode 22 detects the quantity of light which is reflected from the original illuminated by the lamp 3 or from the standard white plate 6. The position of the photodiode 22 is not limited to the illustrated position, and the photodiode can be replaced with another photosensor such as a CCD line sensor.

The mode of operation of the apparatus described above will be described below. When the copy start key (not shown) is depressed, the lamp 3 is turned on and the drum 2 is rotated. After the drum 2 is rotated about once, the platen 1 starts moving forward, and the original on the platen 1 is slit exposed. The reflected light image of the original illuminated by the lamp 3 is slit-exposed on the drum 2 through the rod lens array 14. The photosensitive layer of the drum 2 is pre-exposed by the lamp 23 and uniformly charged by the primary charger 5. When the charged surface of the drum 2 reaches the exposure surface opposing the rod lens array 14, the negative charge image is discharged by the light image. Thus, a negative, electrostatic latent image is formed on the drum surface. Positively charged toner is applied to the latent image to visualize it by the developing unit 8 to which a developing bias obtained by superposing an AC bias on a DC bias is applied. The visualized image is transferred onto a transfer sheet 10 by the transfer charger 9. The transfer sheet 10 is picked by the timing operation of the pickup roller 13 from the cassette 11, and is passed through to the transfer region at a speed the same as the drum peripheral speed by the register rollers 17. The sheet after the image transfer operation is separated from the drum 2 by the roller 18, and is supplied to the fixing rollers 20. After the image is fixed, the sheet 10 is exhausted into the tray 16 by the roller 21. The drum surface after the transfer operation is discharged by the cleaning predischarger 12, and is cleaned by the cleaner 15.

When multiple copying is performed from a single original, the reciprocating operation of the platen 1 is repeated a number of times set by the ten keys of the control panel of the copying machine.

Light quantity control of the lamp (fluorescent lamp) 3 and automatic image density control (AE function) of the copying machine according to the present invention will be described below.

Figure 2:
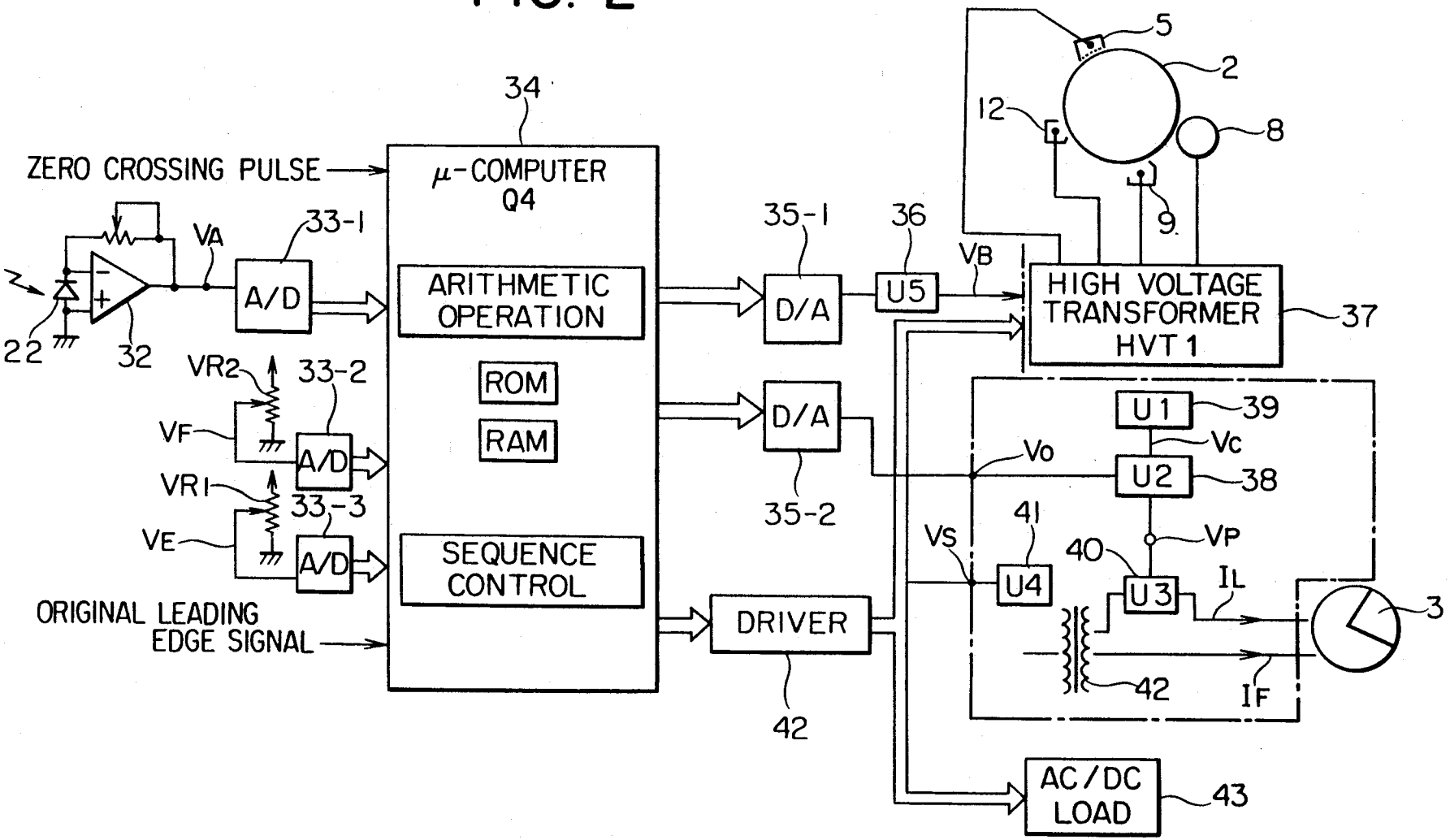
FIG. 2 is a block diagram of a control circuit according to the present invention.

FIG. 2 is a block diagram of a control circuit for controlling the quantity of light emitted by the lamp and for performing AE control. A photodiode 22 in FIG. 2 corresponds to the photodiode 22 in FIG. 1. A photocurrent of the photodiode 22 is converted into a voltage by an operational amplifier 32, and produces a light quantity detection output VA of a voltage corresponding to the quantity of light incident on the photodiode 22. The light quantity detection output VA is converted into an 8-bit digital value by an analog-digital (A/D) converter 33 1. A/D converters 33-2 and 33-3 perform A/D conversion of a reference level VF from a variable resistor VR2 for setting this level as a reference quantity for the quantity of light emitted by the lamp and an AE level VE from a variable resistor VR1 for AE density setting. As in the case of the light quantity detection output VA, these values VF and VE are converted into 8-bit digital values.

A 1-chip microcomputer 34 has a RAM, a ROM, an operation section and the like. The 8-bit digital value from the A/D converter 33-1 is supplied to the microcomputer 34. The microcomputer 34 frequently obtains 8-bit digital values at predetermined timings, operates in accordance with the received digital values, and outputs control data for light quantity control and AE function.

Digital/analog (D/A) converters 35-1 and 35-2 convert 8-bit digital data from the microcomputer 34 into analog data. A level shifter 36 shifts the level of the output from the D/A converter 35-1 and obtains an AE control voltage VB. The AE control voltage VB is supplied to a high voltage transformer 37. The high voltage transformer 37 supplies a developing bias to the developing unit 8 shown in FIG. 1 and a high voltage to the transfer charger 9, the cleaning discharger 12, and the primary charger 5. The high voltage transformer 37 changes the developing bias to be applied to the developing unit 8 in accordance with the AE control voltage VB.

Figure 3:
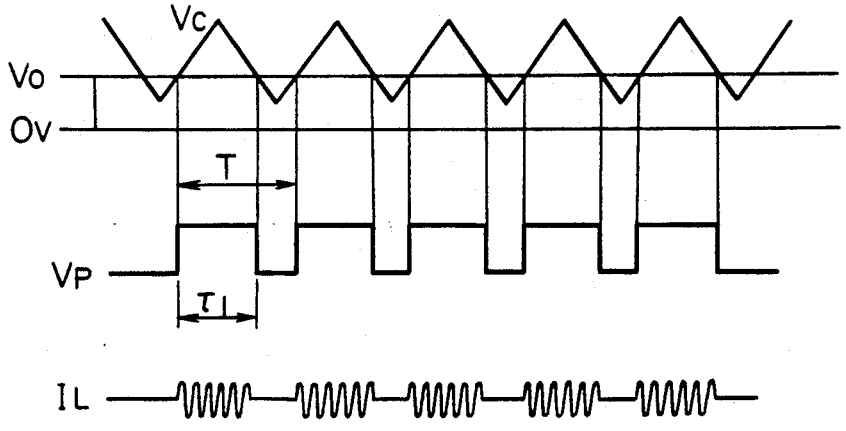
FIG. 3 is a timing chart of PWM modulation.

An output from the D/A converter 35-2 is supplied as a threshold voltage V0 to a PWM modulator 38 comprising a monostable multivibrator. The PWM modulator 38 further repeatedly receives a triangular wave Vc of period T from a pulse generator 39 comprising an astable multivibrator. The PWM modulator 38 compares the triangular wave Vc and the threshold voltage V0 and generates an output pulse train Vp which is PWM modulated in accordance with the level of the threshold voltage V0. FIG. 3 shows the operation of the PWM modulator 38. Thus, a pulse train Vp of a duty factor $\tau 1/T$ corresponding to the threshold voltage V0 is generated.

A converter oscillator 41 and an inverter transformer 42 form a high-frequency voltage for driving the lamp 3. A switching circuit 40 turns on or off in accordance with the output pulse train Vp from the PWM modulator 38 and switches the high-frequency voltage from the inverter transformer 42 as shown in FIG. 3. Thus, a lamp current IL is supplied to the lamp 3. In this manner, the duty factor of the high-frequency voltage supplied to the lamp 3 is determined in accordance with the duty factor of the output pulse train Vp from the PWM modulator 38. Note that IF is a current for preheating the filament of the lamp 3.

A driver 42 generates an operation control signal for the high voltage transformer 37, the converter oscillator 41 and other AV or DC loads 43 in accordance with the output from the microcomputer 34. Although the light quantity control and AE function are shown in detail in FIG. 2, the microcomputer 43 performs sequence control of other drive sections and process sections of the copying machine.

The operation of the circuit shown in FIG. 2 will be described below.

Figure 4:
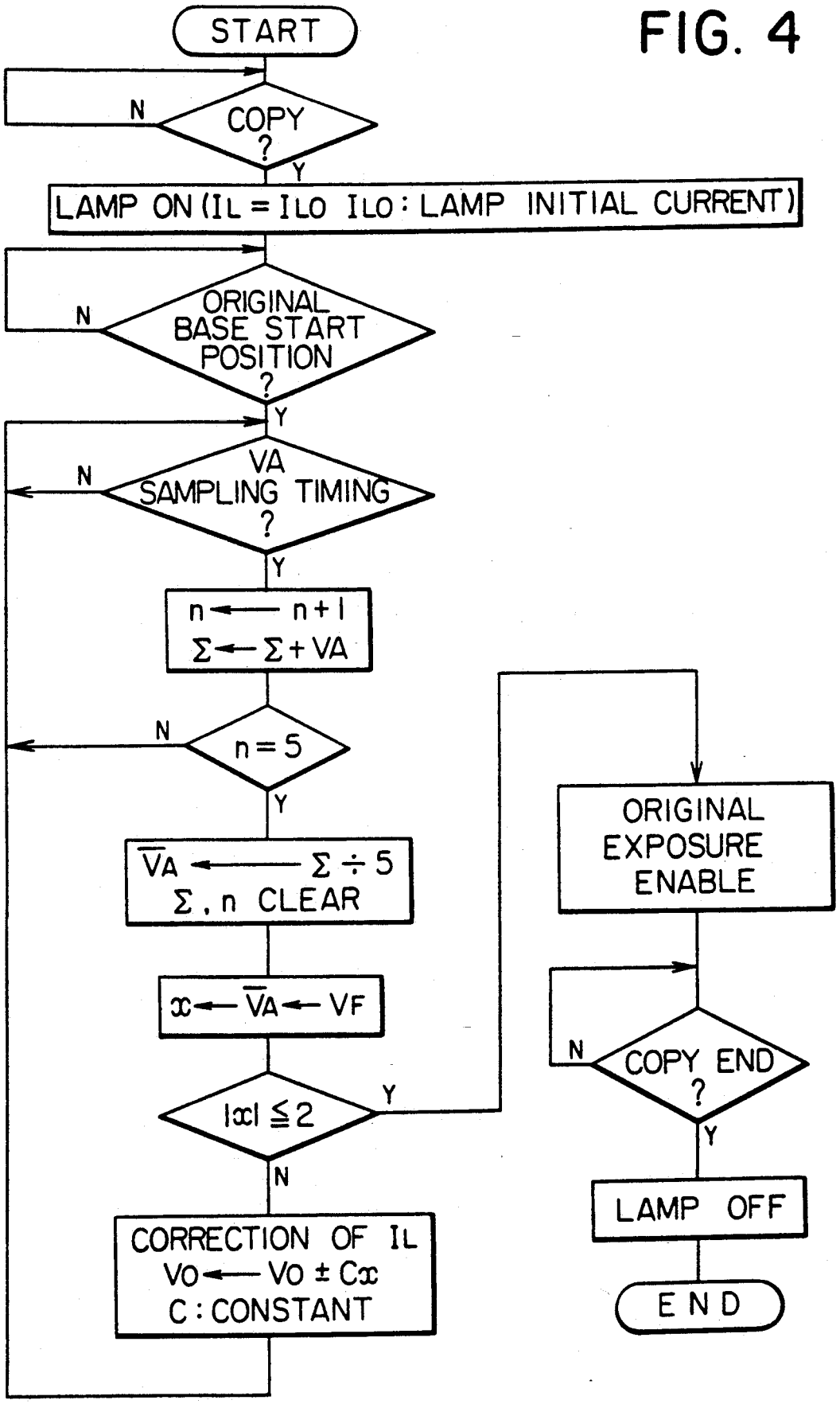
FIG. 4 is a flow chart of light quantity control.

The light quantity control of the lamp 3 will be described with reference to FIG. 2. FIG. 4 shows a flow chart showing the control sequence for light quantity control. Light quantity control is performed before original exposure. Thus, when the copy start key (not shown) is depressed in order to start original exposure, the lamp 3 is turned on with the initial current ILO and the platen 1 is moved to the left in FIG. 1. The standard white plate 1 stops at the position (start position) at which it is exposed by the lamp 3. The photodiode 22 receives light reflected by the standard white plate 6. 8-bit data corresponding to the quantity of light reflected from the standard white plate 6 is output from the A/D converter 33-1 as the light quantity detection output VA.

The microcomputer 34 receives a zero crossing pulse of a commercial power source. The microcomputer 34 samples the light quantity detection output VA upon reception of the zero crossing pulse. When the AC power source voltage is 50 Hz, an operation $\Sigma \leftarrow \Sigma + VA$ is performed in accordance with the sampled output VA, and $\Sigma$ is stored in a predetermined area of the memory RAM. The microcomputer 34 also performs an operation $n \leftarrow N+1$. The microcomputer 34 repeats this sampling operation of the light quantity detection output VA until n is 5, i.e., five times. The sum of five samples of the output VA is stored as $\Sigma$ in the predetermined area of the RAM.

When five sampling operations of the light quantity detection output VA are completed, the sum $\Sigma$ is divided by 5. An average value $\overline{VA}$ of five samples is obtained. The sum and n are cleared for the next sampling operation. The reflected light quantity data $\overline{VA}$ thus obtained corresponding to the standard white plate 6 is compared with a reference level VF from the variable resistor VR2 read in through the A/D converter 33-2. The current supply to the lamp 3 is controlled so that the data VA substantially coincides with the reference level VF.

When the lamp quantity is below a preset level, $\overline{VA} < VF$, the threshold voltage V0 of the PWM modulator 38 is decreased so as to decrease the duty factor of the high-frequency voltage of the lamp 3. Thus, the lamp current IL is increased, and the quantity of light emitted by the lamp 3 is increased. However, when the lamp light quantity is higher than the preset level, $\overline{VA} > VF$, the threshold voltage V0 is increased and the duty factor of the high-frequency voltage of the lamp 3 is decreased. As a result the quantity emitted by light of the lamp 3 is decreased.

As described above, according to this embodiment, the outputs from the A/D converters 33-1 and 33-2 are 8-bit signals, providing 256 step data. Therefore, the quantity of light emitted by the lamp is determined at the threshold level V0 when the VA reaches a value at which $|\overline{VA} - VF| \leqq 2LSB$.

When the light quantity of the exposure lamp is determined in this manner, exposure of the original as started, and the copy operation is started. The quantity of light is set at a predetermined level during the copy operation. A heater for stabilizing the quantity of light emitted by the lamp can be arranged, and the ambient temperature of the lamp 3 (fluorescent lamp) can be controlled by the heater.

The AE function in the original exposure when the light quantity control as described above is completed as described above will be described below. According to the AE function according to this embodiment, the developing bias for the developing unit 8 is controlled in accordance with the quantity of light reflected from an original, and the density of the copy image is controlled to be optimal thereby.

Figure 5:
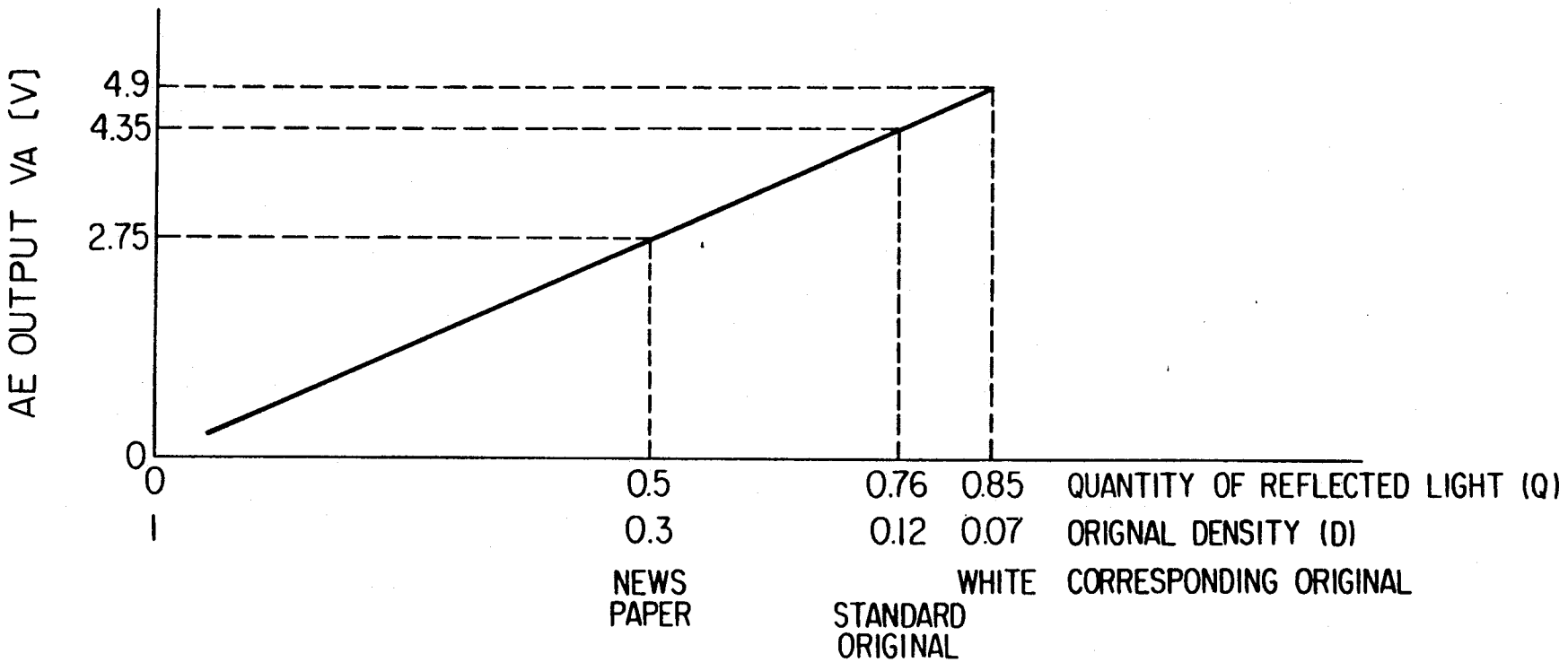
FIG. 5 is a graph showing light quantity detection outputs as a function of density of various originals.

When light quantity control as described above ends, the platen 1 starts moving from the start position to the right in FIG. 1. Then, the photodiode 22 receives light reflected from the original on the platen 1 which is exposed by the lamp 3. The output from the A/D converter 33-1 is digital data corresponding to the original density. FIG. 5 shows the relationship between the light quantity detection output VA and the original density. As can be seen from FIG. 5, the output VA increases with an increase in brightness of the original.

Figure 6:
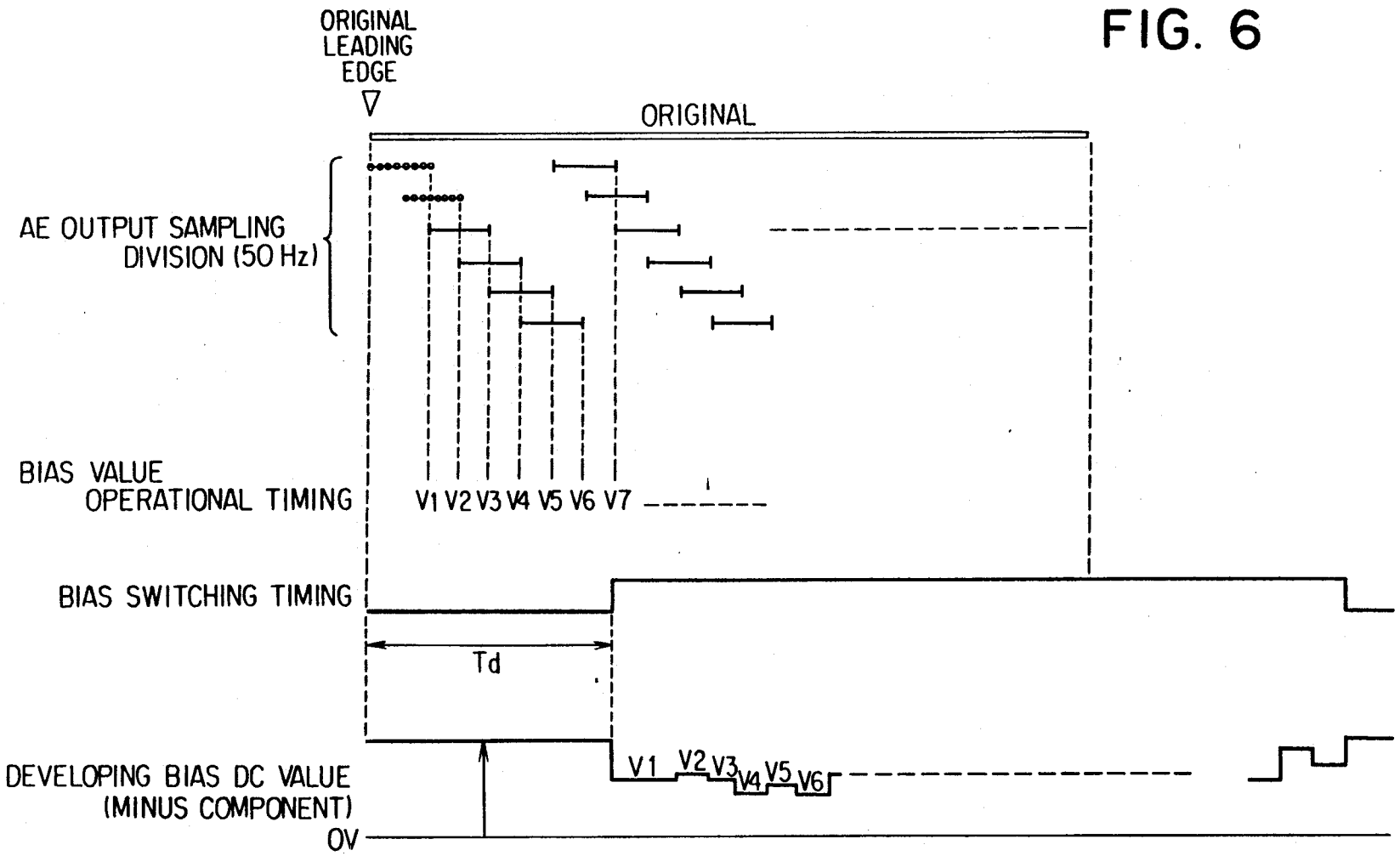
FIG. 6 is a timing chart showing the relationship between the sampling timings of the light quantity detection outputs and developing bias control operation.

Upon reception of a signal representing that the leading edge of the original on the platen has reached the exposure position, the microcomputer 34 starts sampling the output from the A/D converter 33-1. As in the case of the light quantity as described above, this sampling is performed during input of the zero cross pulse to the microcomputer 34. FIG. 6 shows the relationship between the sampling timings of the light quantity detection output VA by the microcomputer 34 and the developing bias control. Upon reception of each zero cross pulse, the microcomputer 34 calculates an average value $\overline{VA}$ of values of output VA at 8 successive points, and calculates a developing bias Vn corresponding to the original density in accordance with the average value $\overline{VA}$. As can be seen from FIG. 6, each sample interval of 8 points overlaps the previous and subsequent adjacent intervals by 4 points each, thus effecting a determination or discrimination of image density for each of a plurality of regions, which in the present embodiment partially overlap each other. This is for the following purpose. When the developing bias for an electrostatic latent image on the drum developed by the developing bias Vn is determined considering density in adjacent regions, extreme or abrupt changes in density at points of changes in developing bias can be prevented.

The developing bias determined in this manner is stored in a predetermined area of the RAM. After a delay time of Td until the latent image of the image density detected by the photodiode 22 reaches the developing position, the developing bias stored in the RAM is output to the D/A converter 35-1.

Figure 7:
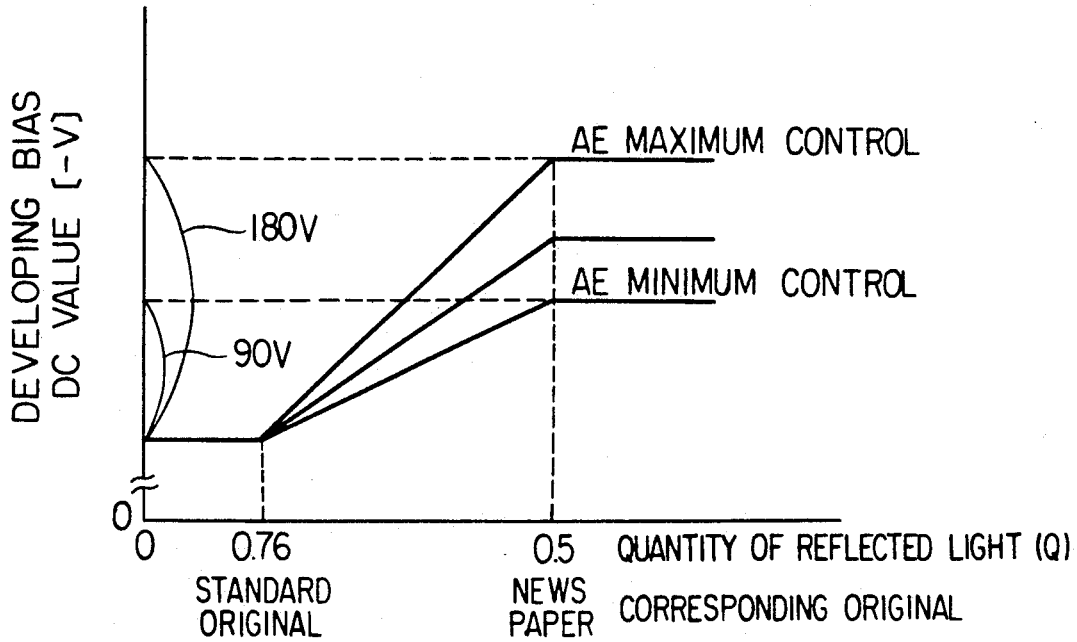
FIG. 7 is a graph showing the developing bias as a function of the original density.

FIG. 7 shows the relationship between the original density (reflected light quantity) for the AE function by the microcomputer 34 and the developing bias DC value. As can be seen from FIG. 7, the bias value increases linearly with original density from a standard original to newspaper. Specific developing biases are determined for original densities higher than the standard original or lower than the newspaper. With this AE control, a copy image of a dark original will not become too dark, or a copy image of a bright original with characters can be reproduced clearly. The slope of the line in FIG. 7 is determined by the AE level VE from the variable resistor VR1 shown in FIG. 2. Therefore, manual density setting can be performed in addition to automatic density control by the AE function.

In this manner, the developing bias is sequentially controlled in accordance with the original density, and the latent image formed on the drum is developed. Therefore, a copy image can be formed at a desired density.

An analog output from the D/A converter 35-1 is subjected to predetermined level shifting by the level shifter 36, and is applied to the high voltage transformer 37. As described above, the high voltage transformer 37 controls the developing bias of the developing unit 8 in accordance with the value of the AE control voltage VB.

Figure 8:
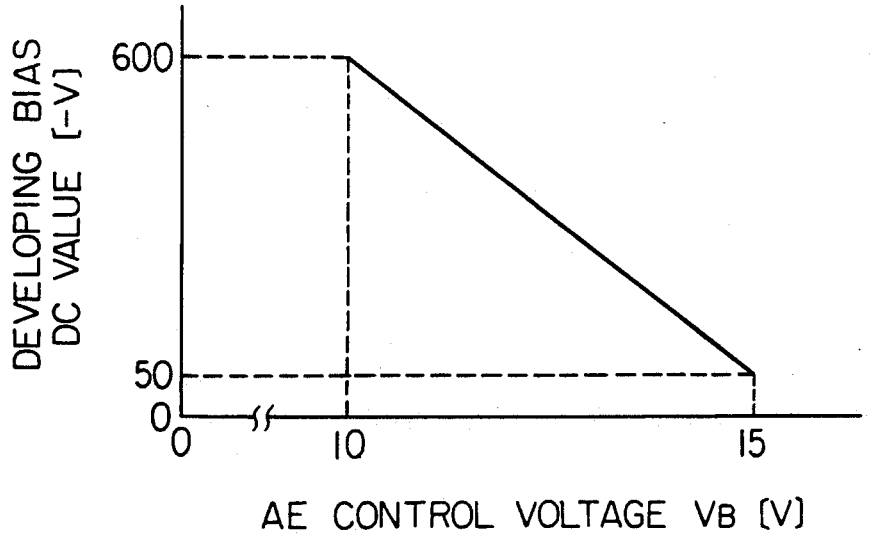
FIG. 8 is a graph showing the developing bias as a function of the AE control voltage.

FIG. 8 shows the relationship between the AE control voltage VB from the level shifter 36 and the developing bias BC value of the high voltage transformer 37.

According to the present invention, during multicopying of a single original, the density of the original is sampled, and the developing bias is controlled in accordance with the sampling data, thereby allowing copying operation at proper density.

In the AE control according to this embodiment, the original density is measured during original exposure. However, prescanning for measuring the original density can be performed before original exposure. After the developing bias is determined in accordance with the prescan data, scanning (original exposure) for copying operation can be performed.

In the above embodiment, an original base (Platen) moving type copying machine is described. However, the present invention is similarly applicable to an original base fixed type copying machine. Furthermore, the present invention is similarly applicable to light quantity control and original density measurement in apparatuses for photoelectrically reading original images, such as facsimile systems or digital copying machine.

A halogen lamp or the like can be used in place of the fluorescent lamp as a light source for exposing the original.

According to the present invention, a light source for original exposure can be stabilized, and an original exposure can be performed at optimal conditions. Not only light quantity control but also process control suitable to each original density can be performed with a simple construction.

In the arrangement described above, the light quantity of a light source for exposing an original can be kept at a predetermined value. Therefore, in a copying machine, for example, a copy image of an excellent image density can be formed.

Measurement of the original density is performed under optimal original exposure conditions, so that a correct density measurement can be obtained.

Operation control of the process means is performed for image formation of the original exposed by an optimal quantity of light. Therefore, an image of excellent density can be formed irrespective of the light quantity of the light source.

Light quantity control of the light source and the density measurement of the original can be performed by a common detecting means, so that the construction is simplified and the cost is decreased.

Although the present invention has been described with reference to a preferred embodiment thereof which is applied to a copying machine, the present invention is not limited to this and various changes and modifications can be made within the spirit and scope of the present invention.

What is claimed is:

1. An original image exposing apparatus comprising:

a light source for exposing an original with a quantity of light corresponding to an amount of electric power supplied thereto;

means for detecting a quantity of light from a standard section and the original exposed by said light source;

means for sampling an output from said detecting means in response to zero crossing pulses of an AC power source;

means for determining the amount of electric power to be supplied to said light source in accordance with M samples from said sampling means when the standard section is being exposed by said light source so as to expose the original with a reference quantity of light; and means for discriminating an image density of the original in accordance with N samples, N being greater than M, from said sampling means when the original is being exposed with the reference quantity of light be said light source to which the amount of electric power determined by said determining means by being supplied.

2. An apparatus according to claim 1, further comprising means for forming an image on a recording medium based on the original image exposed by said light source.

3. An apparatus according to claim 2, wherein said discriminating means discriminates an image density of the original while an image forming operation is performed by said forming means.

4. An apparatus according to claim 2, further comprising control means for controlling an image forming operation of said forming means in accordance with the image density discriminated by said discriminating means.

5. An apparatus according to claim 1, wherein said detecting means is adapted to output a digital value representing the detected quantity of light.

6. An apparatus according to claim 1, wherein said light source is a fluorescent lamp which exposes the original with a quantity of light corresponding to a duty factor of a high frequency voltage supplied thereto.

7. An apparatus according to claim 6, wherein said determining means determines the duty factor of the high frequency voltage to be supplied to said fluorescent lamp.

8. An original image exposing apparatus comprising:

a light source exposing an original with a quantity of light corresponding to an amount of electric power supplied thereto;

means for forming an image on a recording medium based on an image of the original exposed by said light source;

means for detecting a quantity of light from a standard section and the original exposed by said light source;

means for sampling an output from said detecting means in response to zero crossing pulses of an AC power source;

means for determining the amount of electric power to be supplied to said light source in accordance with M samples from said sampling means when the standard section is being exposed by said light source so as to expose the original with a reference quantity of light; and mean for controlling an image forming operation of said image forming means in accordance with N samples, N being greater than M, from said sampling means when the original is being exposed with the reference quantity of light by said light source to which the amount of electric power determined by said determining means is being supplied.

9. An apparatus according to claim 8, wherein said control means controls a density of an image to be formed by said forming means in accordance with the samples from said sampling means.

10. An apparatus according to claim 8, wherein said detecting means is adapted to output a digital value representing the detected quantity of light.

11. An apparatus according to claim 8, further comprising discriminating means for discriminating an image density of the original in accordance with the samples from said sampling means.

12. An apparatus according to claim 11, wherein said control means controls the image forming operation of said forming means in accordance with the image density discriminated by said discriminating means.

13. An apparatus according to claim 8, wherein said light source is a fluorescent lamp with exposes the original with a quantity of light corresponding to a duty factor of a high frequency voltage supplied thereto.

14. An apparatus according to claim 13, wherein said determining means determines the duty factor of the high frequency voltage to be supplied to said fluorescent lamp.

15. An original image exposing apparatus comprising:

a fluorescent lamp for exposing an original with a quantity of light corresponding to a duty factor of a high-frequency voltage supplied thereto;

means for forming an image n a recording medium based on an image of the original exposed by said fluorescent lamp;

means for detecting a quantity of light from a standard section and the original exposed by said fluorescent lamp at predetermined timings;

means for determining the duty of the high-frequency voltage supplied to said fluorescent lamp in accordance with M samples by said detecting means when the standard section is being exposed by said fluorescent lamp so as to expose the original with a reference quantity of light; and means for controlling an image forming operation of aid image forming means in accordance with N samples, N being greater than M, by said detecting means when the original is being exposed with the reference quantity of light by said fluorescent lamp to which the duty factor of the high-frequency voltage determined by said determining means is being supplied.

16. An apparatus according to claim 15, wherein said detecting means is adapted to output a digital value representing the detected quantity of light.

17. An original image exposing apparatus comprising:

a fluorescent lamp for exposing the original with a quantity of light corresponding to a duty factor of a high frequency voltage supplied thereto;

means for detecting a quantity of light from a standard section and the original exposed by said fluorescent lamp;

means for sampling an output from said detecting means at a predetermined timing;

means for determining the amount of electric power to be supplied to said light source in accordance with M samples from said sampling means when the standard section is being exposed by said light source so as to expose the original with a reference quantity of light; and means for discriminating an image density of the original in accordance with N samples, N being greater than M, from said sampling means when the original is being exposed with the reference quantity of light by said light source to which the amount of electric power determined by said determining means is being supplied.

18. An apparatus according to claim 17, further comprising means for forming an image on a recording medium based on the original image exposed by said fluorescent lamp.

19. An apparatus according to claim 17, wherein said detecting means is adapted to output a digital value representing the detected quantity of light.

20. An apparatus according to claim 18, further comprising control means for controlling an image forming operation of said forming means in accordance with the image density discriminated by said discriminating means.

* * * * *

UNITED STATES PATENT AND TRADEMARK OFFICE

CERTIFICATE OF CORRECTION

PATENT NO. : 5,260,745

DATED : November 9, 1993

INVENTOR(S) : YOSHIAKI TAKAYANAGI

It is certified that error appears in the above-identified patent and that said Letters Patent is hereby corrected as shown below:

IN [57] ABSTRACT

Line 7, "vias" should read --bias--.

COLUMN 1

Line 24, "images" should read --images of--.
Line 61, "of" should read --for--.

COLUMN 2

Line 12, "detected" should read --detecting--.
Line 68, "formed" should be deleted.

COLUMN 5

Line 49, "result" should read --result,-- and "emitted by light of" should read --of light emitted by--.
Line 53, "256 step" should read --256-step--.
Line 58, "as" should read --is--.

COLUMN 7

Line 21, "(Platen)" should read --(platen)--.

COLUMN 8

Line 14, "be" should read --by--.
Line 16, "by" should read --is--.

UNITED STATES PATENT AND TRADEMARK OFFICE

CERTIFICATE OF CORRECTION

PATENT NO. : 5,260,745

DATED : November 9, 1993

INVENTOR(S) : YOSHIAKI TAKAYANAGI

It is certified that error appears in the above-identified patent and that said Letters Patent is hereby corrected as shown below:

COLUMN 9

Line 17, "with" should read --which--.
Line 28, "n" should read --on--.
Line 41, "aid" should read --said--.

Signed and Sealed this

Twelfth Day of July, 1994

Bruce Lehman

*Attest:*

BRUCE LEHMAN

*Attesting Officer*

*Commissioner of Patents and Trademarks*